US005399021A

United States Patent [19]

Litt

[11] Patent Number: 5,399,021

[45] Date of Patent: Mar. 21, 1995

[54] CREDIT CARD HOLDER

[76] Inventor: Lesley Litt, 10 Oxford Rd., Rockville Centre, N.Y. 11570

[21] Appl. No.: 25,084

[22] Filed: Mar. 2, 1993

[51] Int. Cl.[6] ..... B65D 33/34

[52] U.S. Cl. ..... 383/5; 283/72; 283/904; 229/92.8

[58] Field of Search ..... 383/5, 110; 229/72, 229/92.1, 92.8; 283/72, 95, 904

[56] References Cited

U.S. PATENT DOCUMENTS

| | | | |
|---|---|---|---|
| 3,221,428 | 12/1965 | Fischler et al. | 283/95 X |
| 3,508,702 | 4/1970 | Kalser | 229/92.8 X |
| 3,773,251 | 11/1973 | Hadick | 229/92.8 |
| 4,120,445 | 10/1978 | Carrier et al. | 383/5 X |
| 4,273,362 | 6/1981 | Carrier et al. | 383/5 X |
| 4,407,443 | 10/1983 | McCorkle | 383/5 X |
| 4,511,908 | 4/1985 | Small | 283/904 X |
| 4,749,084 | 6/1988 | Pereyra | 383/5 X |
| 5,143,279 | 9/1992 | Gaires | 229/71 X |

FOREIGN PATENT DOCUMENTS

| | | | |
|---|---|---|---|
| 2123791 | 2/1984 | United Kingdom | 383/5 |
| 2243143 | 10/1991 | United Kingdom | 383/5 |
| 2249475 | 5/1992 | United Kingdom | 229/71 |

*Primary Examiner*—Allan N. Shoap
*Assistant Examiner*—Jes F. Pascua
*Attorney, Agent, or Firm*—Bauer & Schaffer

[57] ABSTRACT

A tamper-proof and/or tamper-evident bag or envelope is provided for transporting of credit cards or debit cards which have raised identifying characters. The bag or envelope includes a tamper strip, a front panel, and a back panel drawing together at the lateral edges of the panels. In use the card is inserted into the bag or envelope with its characters disposed behind the tamper strip and covered by the tamper strip. The inside of the rear panel is then sealed to the outside of the front panel by an improved closure system which utilizes improved folding means and an adhesive strip. The tamper strip may be a thick panel such as a sheet of semi-rigid foam or thickened plastic material to prevent transfer of an impression of the raised characters through a mailing envelope and/or may transmit a warning impression in response to an attempted transfer.

18 Claims, 10 Drawing Sheets

CREDIT CARD HOLDER

FIELD OF THE INVENTION

The present invention relates to a method of preventing theft of information on credit cards, phone cards, or any type of cards in which a thief determines card information from a card which has manually detectable characters such as raised or recessed numbers. It relates further to an apparatus comprising an envelope or bag, which would be tamper-evident and/or tamper-proof.

BACKGROUND OF THE INVENTION

Credit cards are typically mailed to their users in nondescript paper envelopes. Unscrupulous persons have intercepted such envelopes before the addressees received them. An interceptor would then tamper with the envelope in an often successful attempt to determine the credit card characters contained therein. The credit card characters could then be used to fraudulently charge purchases to the addressee's account.

An interceptor can determine the characters within the envelope by applying a piece of paper to the surface of the envelope, against which surface the card characters abut, and rubbing a pencil or carbon against the paper to imprint the image of the raised characters upon the paper.

In other schemes, the envelopes are opened by clandestine means and resealed after the information has been noted.

BRIEF DESCRIPTION

It is an object of the present invention to provide a method and apparatus for shipping credit cards so that any tampering will be prevented in transit. This will assure the addressee that the card information is protected.

It is within the contemplation of the invention to prevent would-be card information thieves from obtaining such information by rubbing a pencil across a piece of paper which has been placed upon an envelope which contains the card inside and thereby creating a graphic image of the raised card characters.

In one embodiment of the invention, a tamper strip is an impression-resistant strip of blown polyethylene foam, or the like, disposed adjacent the credit card and prevents characters or information from being raised at the envelope surface and thus prevents the information from being acquired. In this respect, the card and strip may be enclosed inside a bag constructed of polyethylene, polypropylene, any olefinic polymer or derivative thereof, or any other heat, sonic, chemical, laser or mechanically sealable substance, compound or composite, which facilitates the fabrication of the bag. The material may be opaque or clear on which opaque ink can be printed.

The apparatus comprises a bag, which may be a mailing envelope, having at least a front panel and a back panel with the front panel, in one embodiment of the invention, including an extension folded inwardly to provide an inner front panel forming an enclosed area with the front panel. The back panel extends from the bottom of the front panel and may include at its upper inner end an area of adhesive for sealing the bag by folding the upper end to cover a predetermined area of the outer surface of the upper end of the front panel. The bag may be made of a continuous sheet so that once the front and back panels are folded, the lateral edges of the sheet may be sealed. Similarly, if the front panel includes an extended inner front panel, the edges of the extended panel are sealed along with the edges of the front and back panels. The enclosed front area between the front panel and extension is used to envelop the above-mentioned pressure resistant strip which may be disposed into the envelope in a manual or automated step prior to sealing the edges.

At this stage the envelope may be treated as a bag and packaging the credit card can be accomplished manually or via any type of bagging machinery which utilizes a constant air flow to blow each bag open, so that the walls of the bag separate to allow easy insertion of the card into the bag. After insertion of the card, the bag may be sealed closed via the adhesive on the back panel as mentioned above. It is not recommended to use any type of adhesive tape or hot melt as a sealing vehicle due to the fact that freon spray renders the once nonopenable tape or hot melt openable and reclosable with no detectable evidence; however, usage of tapes and hot melt is not completely ruled out due to advances being made presently with respect to freon resistant tapes and adhesives.

In fact, however, it is recommended to use a band of adhesive material compatible with the bag material with a removable adhesive cover strip along the upper inner end of the back panel. Here the invention contemplates the tamper strip to comprise the band of adhesive material made sufficiently thick so that it may be used as an impression resistant strip by having the upper inner end of the back panel fold over the front panel in the area faced by the enveloped credit card. In such a case, the extended inner front panel may be eliminated as may the separate impression resistant strip.

In another embodiment of the invention, the prevention of viewing and/or of obtaining card information may include the utilization of a layer of ink on the lower inside front panel of the bag. Across this layer of ink would be a tamper strip. This time comprising a carbon transfer strip constructed with an acetate or plastic backing or any type of transfer strip, sheet or material that will retain an imprint of, or transfer any image, imprint, or evidence of having been placed under pressure from an outside force that would cause the raised card characters, plastic or otherwise, to be transferred to the layer of ink. The ink and transfer strip take the place of the aforementioned impression resistant strip or thickened band of adhesive. The acetate or plastic backing of the transfer strip will face the rear wall of the bag with the card between the strip and rear wall with the card numbers or letters facing the transfer strip. The other side of the strip will face the ink on the front panel of the bag and imprint on the ink or become imprinted itself. Also, the carbon, or transfer material, does not necessarily have to be transferred to show that the card has been tampered with. A simple imprint may also be an indication of tampering.

The transfer strip may extend to and be attached at the bag edges via heat or any other type of sealing, including hot melt or adhesive. The strip may be rendered non-free floating from the front to back or viceversa via the front panel extension which may be retained and folded into the bag over the transfer strip.

DETAILED DESCRIPTION OF THE DRAWINGS

The terms, such as front, back, up, down, upper and lower are used merely for convenience. It is not intended to exclude envelopes or bags where the "front" is arguably the back or visa versa because of the areas which may be used for display, for example.

Figure 2:
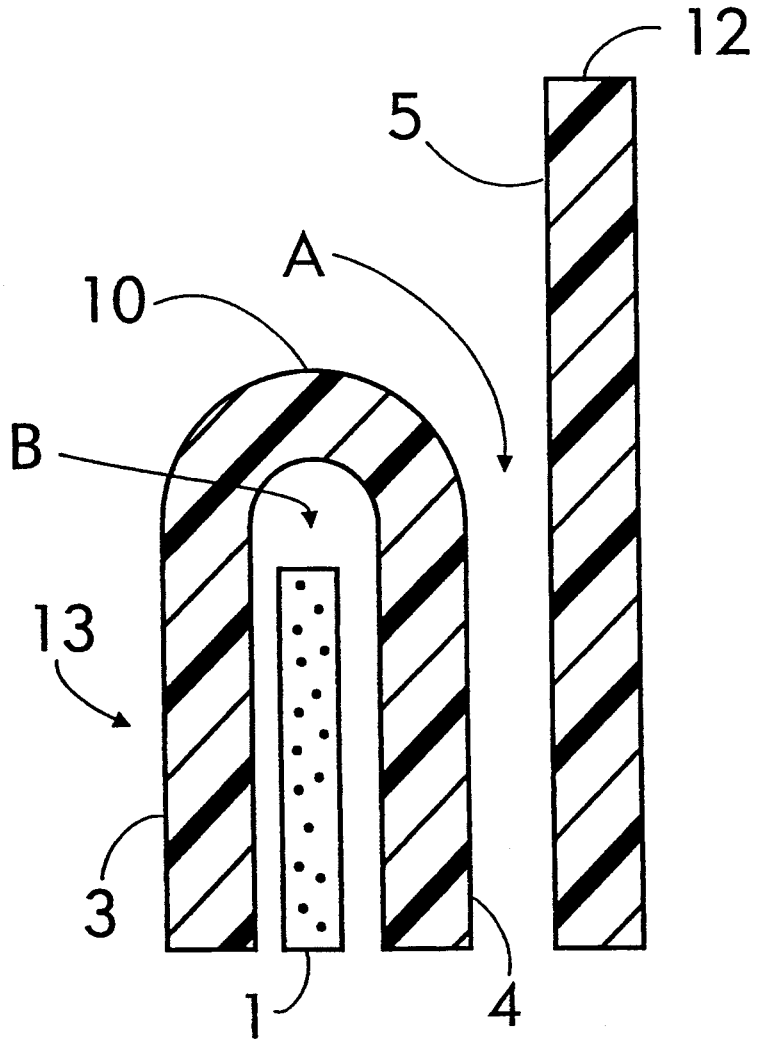
FIG. 2 is an enlarged diagrammatic cross-sectional view taken along the line 2—2 in FIG. 1 but eliminating the bottom edge of the envelope to depict a two sheet construction of the envelope.

As shown in the drawings, a tamper-proof mailing envelope or bag 13 is shown, comprising a single sheet folded as at 10 and 11 to form a front panel 3, an intermediate panel or more properly, an inner front panel 4 and a back panel 5, in turn forming pockets or receptor areas B and A for tamper strip 1 and credit card C, respectively. In FIG. 2 the bag is disclosed as being formed of two sheets, the front panel of which is folded as at 10. The lower edges are sealed to form a bag substantially as formed by the single sheet construction just described.

A tamper strip, 1 made of foam or other material to prevent characters such as credit card numbers from being lifted off a sheet adjacent the envelope from the front by means of rubbing a pencil, is provided within compartment B of envelope 13.

Figure 3:
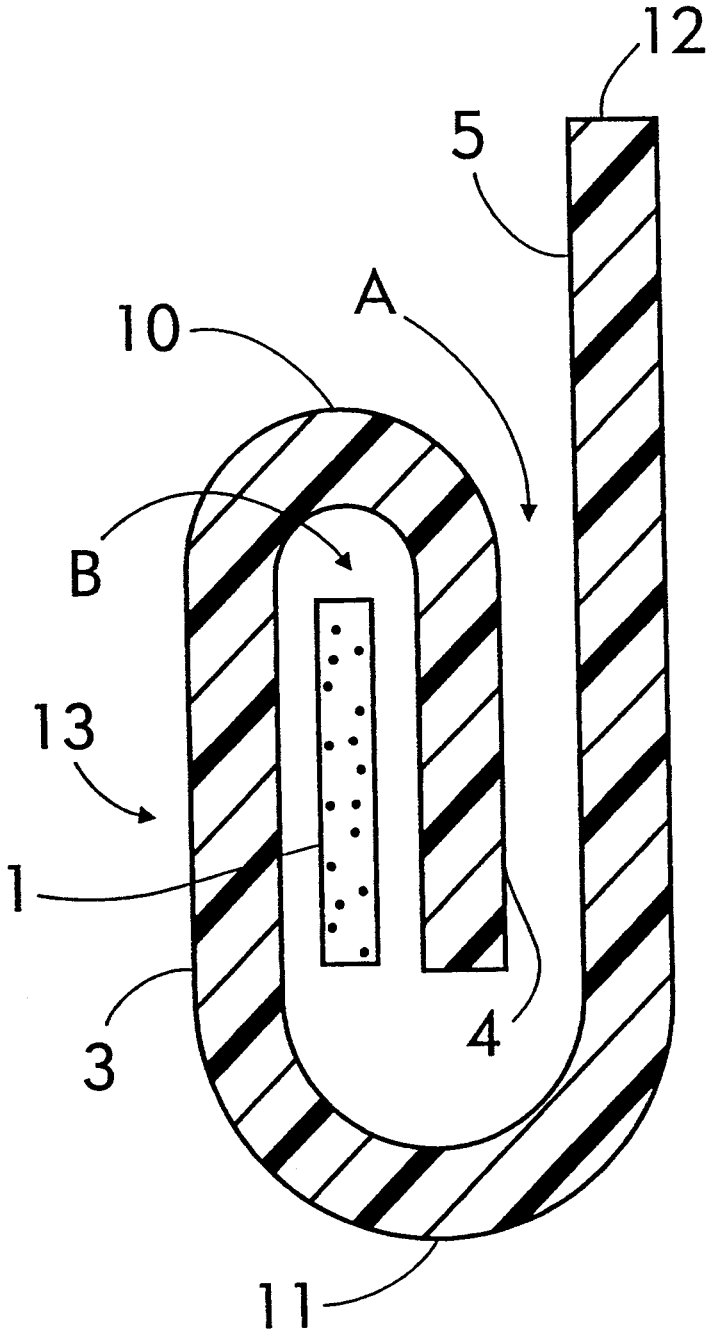
FIG. 3 is a view similar to FIG. 2 but showing the bottom edge of the envelope to depict a single sheet construction.
Figure 3A:
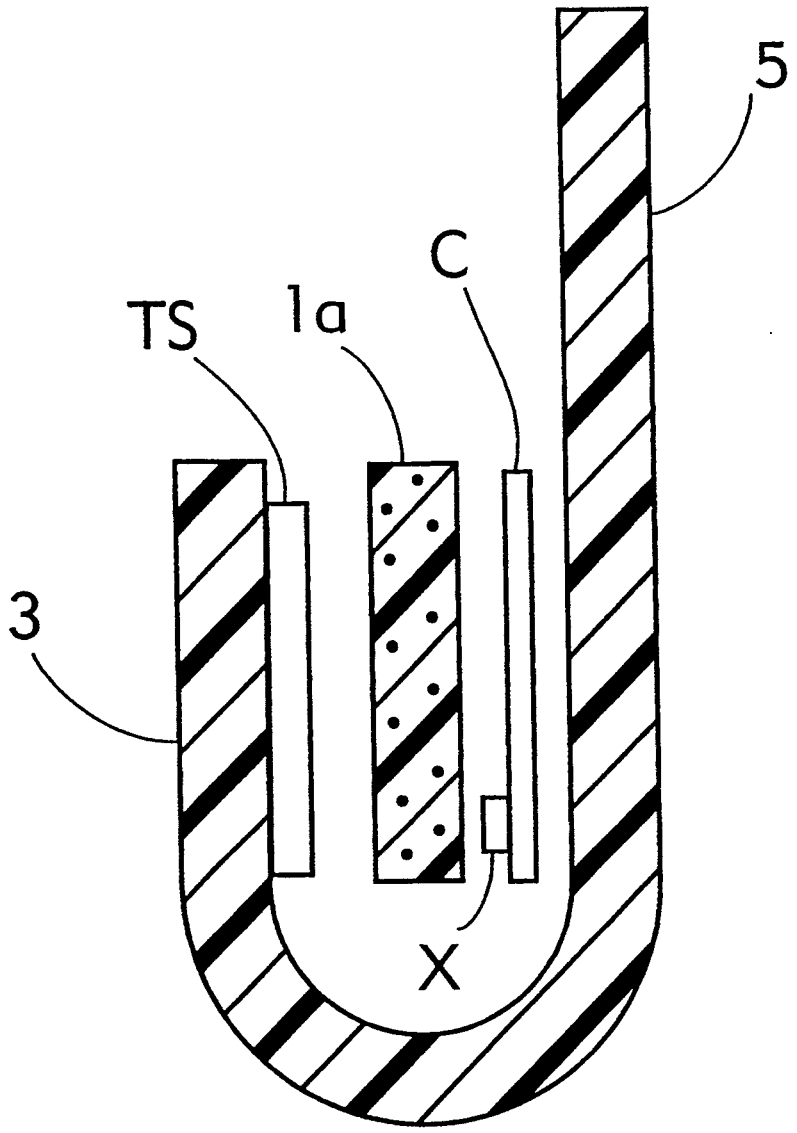
FIG. 3A is a diagrammatic cross-sectional view similar to FIG. 3 showing an alternate arrangement of the invention.

Alternatively, as in FIG. 3*a*, tamper strip 1*a* may be of carbon paper or the like, to transfer the characters X to the inner surface of panel 3. The inner surface of panel 3 may be covered with an ink, TS, which would accept the characters, X, via the carbon paper. Such ink transfers are, of course, evidence of tempering resulting from response to pressure outside the envelope.

Figure 1:
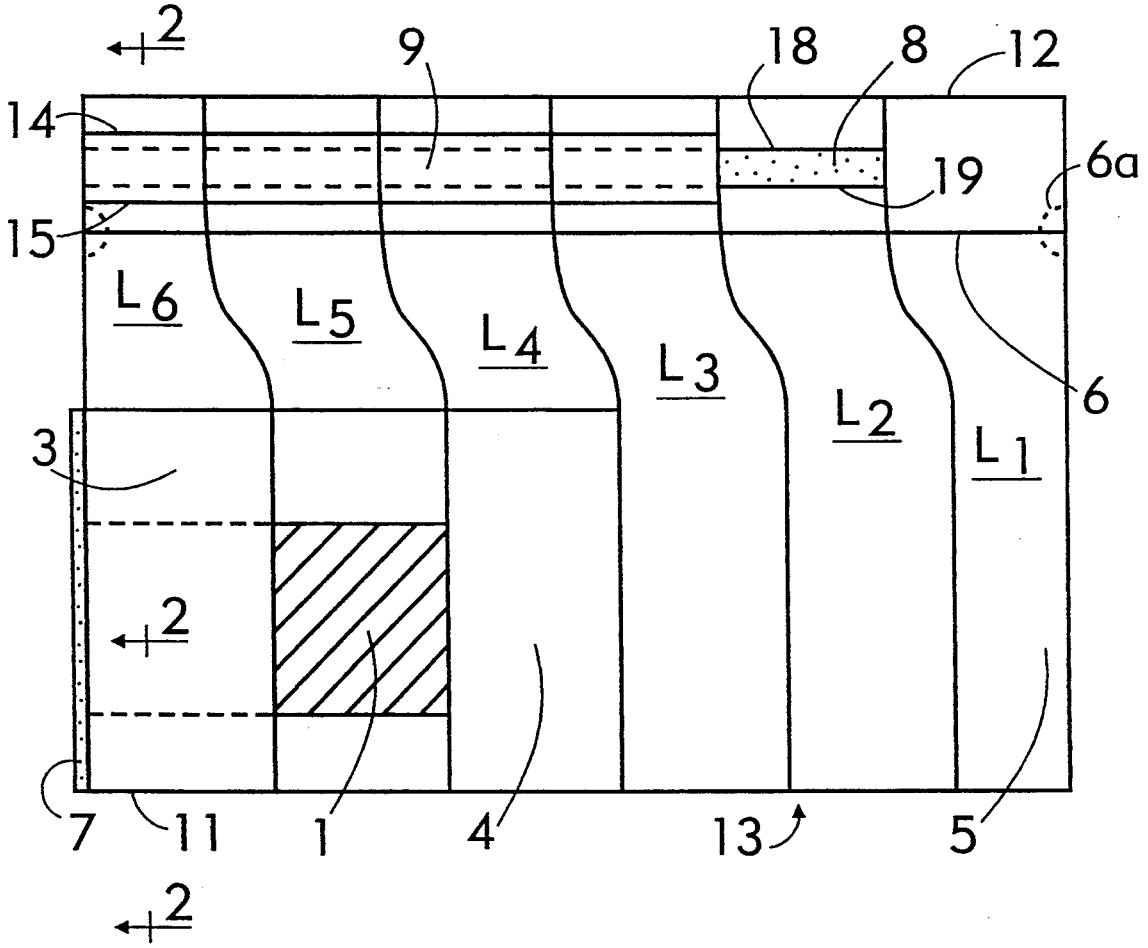
FIG. 1 is a multiple cut-away frontal view showing the front of an open envelope constructed in accordance with the invention, taken through a plurality of levels L1 through L6.

Front panel 3 is shown as an element of layer L6 in FIG. 1 and is the outer portion of the envelope. The envelope sheet material may be polypropylene, polyethylene, or any olefinic polymer or derivative thereof or any heat, sonic, chemical, laser, or mechanically sealable substance.

In the preferred embodiment, the bag is polyethylene in order to facilitate heat sealing to the blown polyethylene foam or high gauge polyethylene strip, 1, as the melting temperatures of all are close.

In the preferred embodiment, a 4 mm thick strip is sufficiently thick to prevent the characters from being raised outside the envelope, yet is thin and light enough not to impose a significant mailing weight penalty. It may also be smaller than the mailing bag in frontal area, thus further reducing mailing weight.

As shown in FIG. 1, a score or serration 6 is made across back panel 5 in order to facilitate precise folding over of back panel 5. Notch 6A, shown only in FIG. 1 in dotted lines, may also or alternatively be provided to facilitate folding. On the forward or inner surface of the upper end of back panel 5, an adhesive is disposed across the width of the back panel to form a band of adhesive 8 between upper and lower margins 18 and 19 which is then covered with a silicone coated release liner strip 9 having upper and lower edges 14 and 15.

The three layers of the envelope are joined at the envelope's sides by a fusion diagrammatically depicted at 7 and 16.

Figure 8:
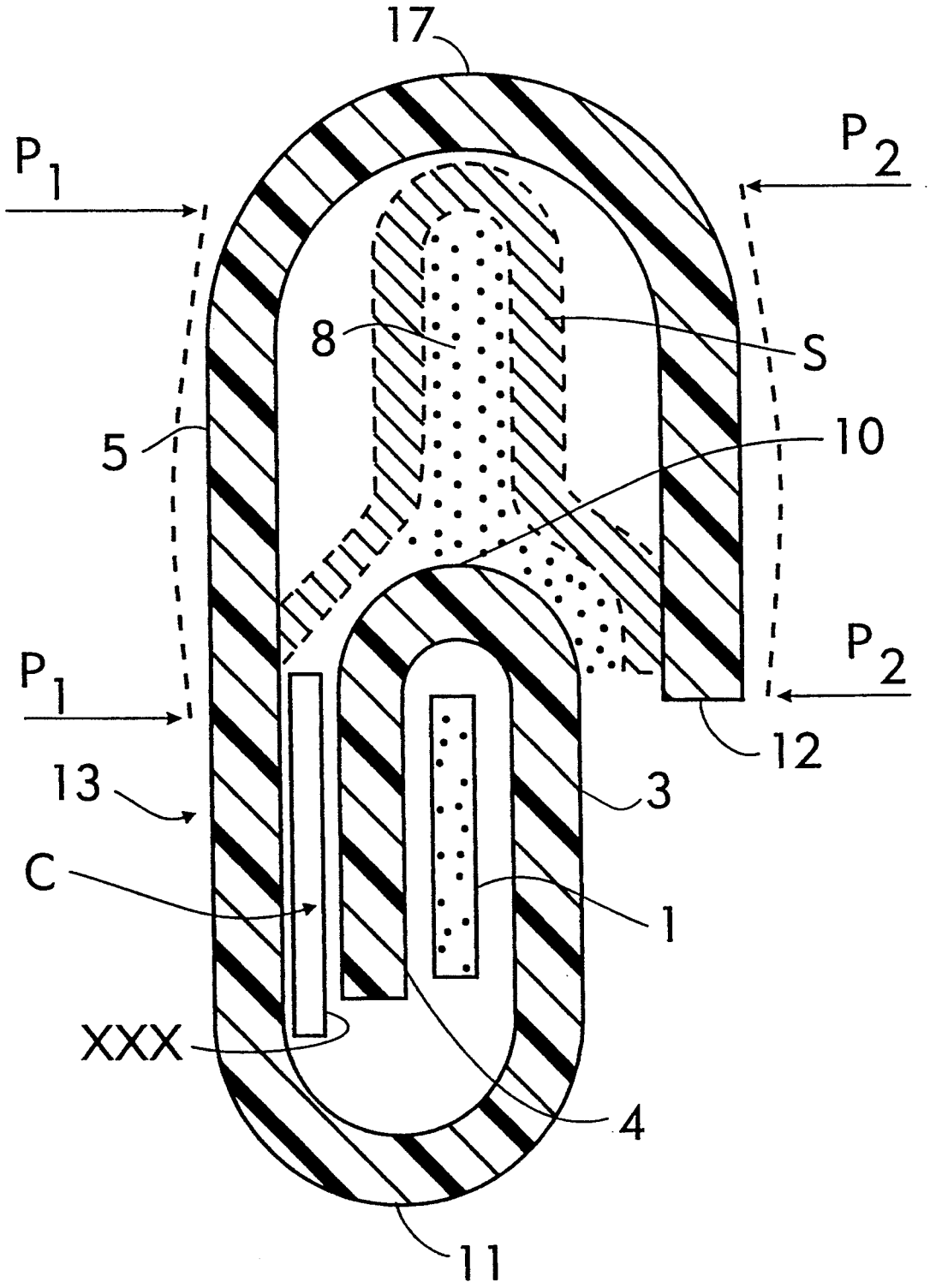
FIG. 8 is an enlarged diagrammatic cross-sectional view taken along the line 20—20 in FIG. 7.

Card C is depicted in the figures as having raised characters XXX. In FIG. 8 line P1—P1 and line P2—P2 are delineated to represent areas on which pressure can be applied in order to create adhesive contact between adhesive band 8 and the two inner sides of folded panel 5. Adhesive contact is also achieved between the inner surface of back panel 5 and the outer surface of front panel 3 at the free end of panel 5.

Figure 4:
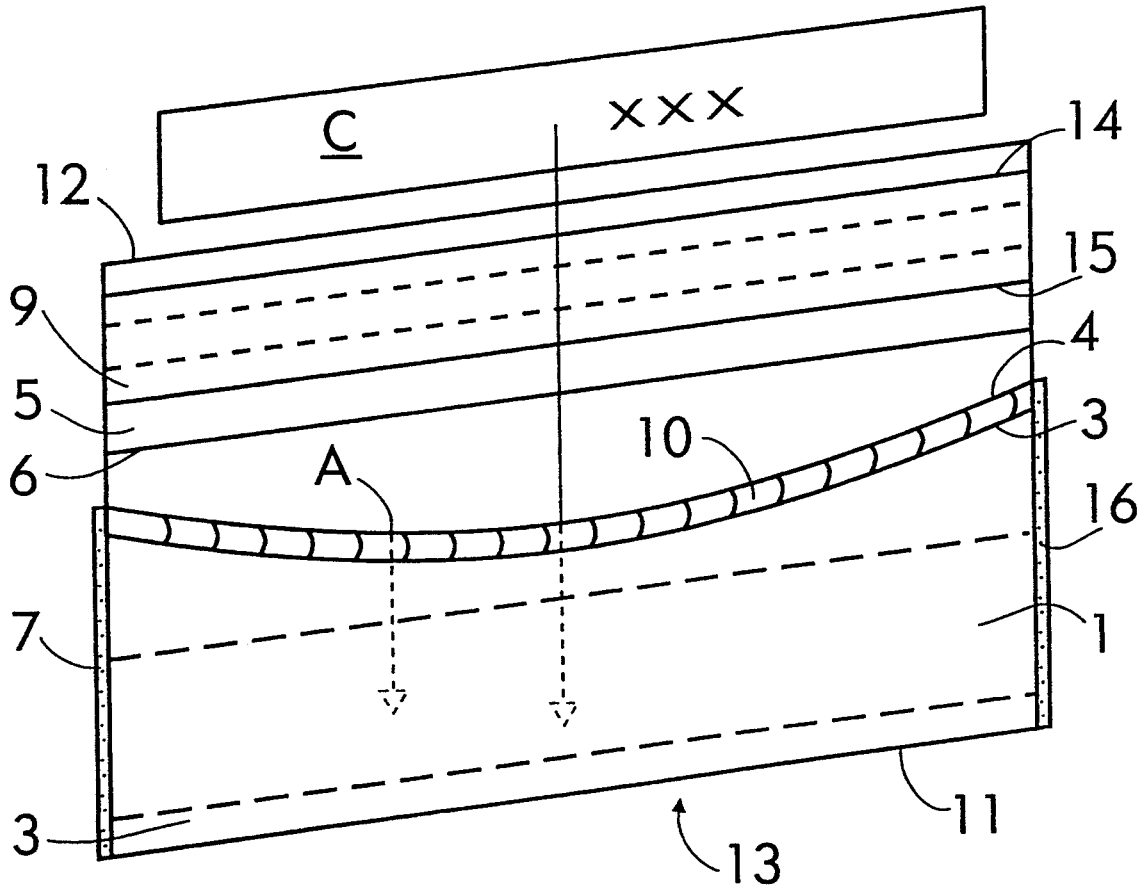
FIG. 4 is a diagrammatic oblique frontal view of the envelope with its pocket open to receive a credit card.
Figure 5:
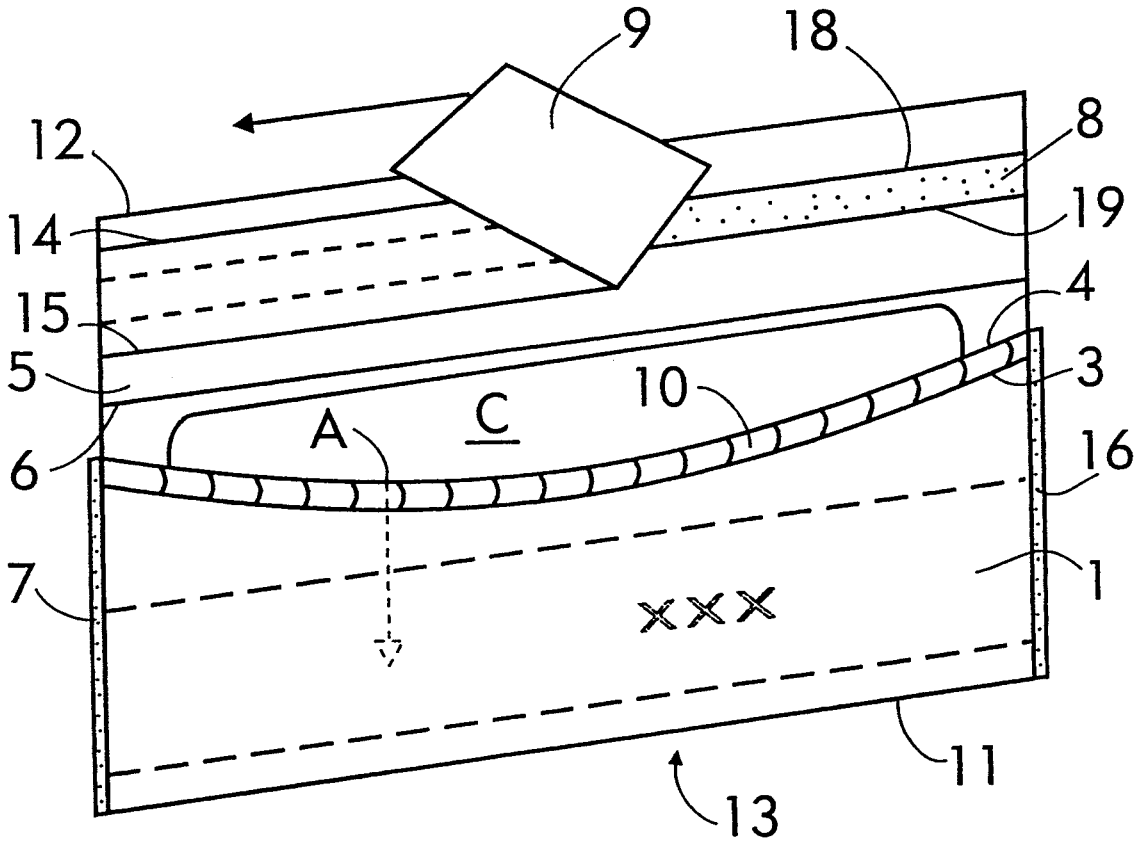
FIG. 5 is a view similar to FIG. 4 and showing the credit card in place with a release liner strip partially removed.
Figure 6:
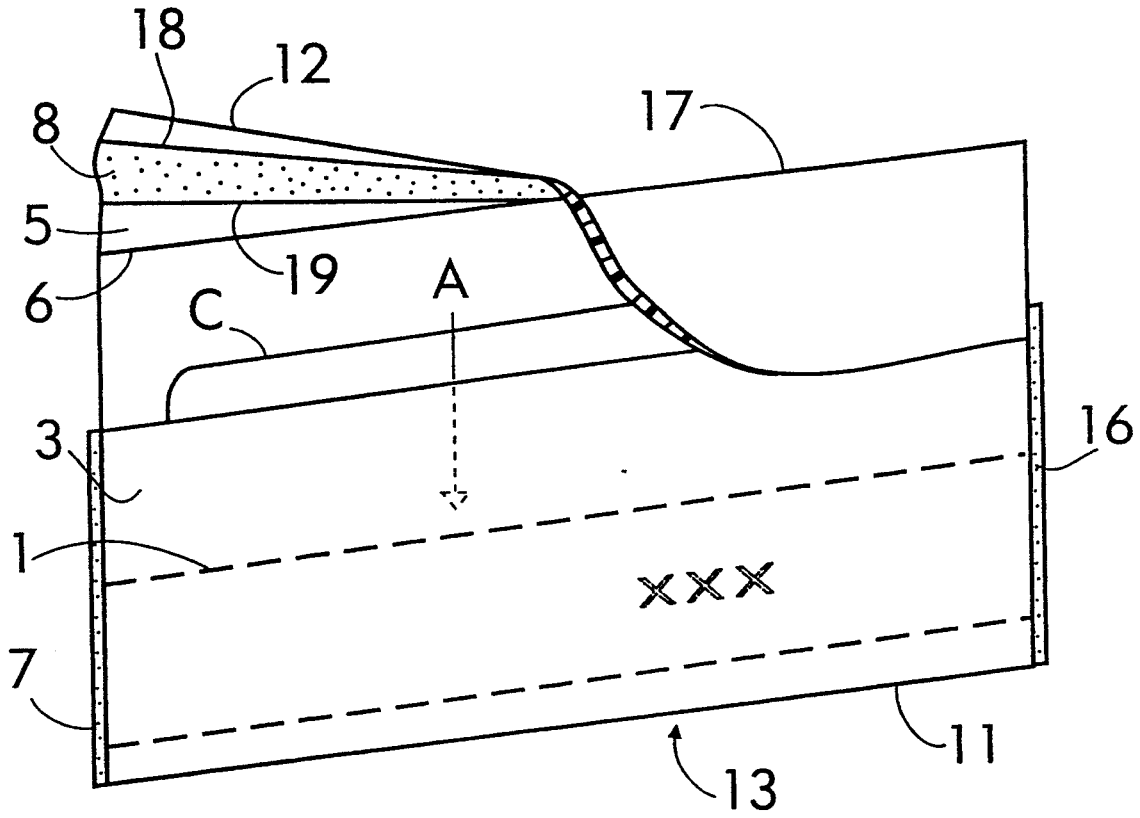
FIG. 6 is a view similar to FIGS. 4 and 5 showing an envelope partially closed.
Figure 7:
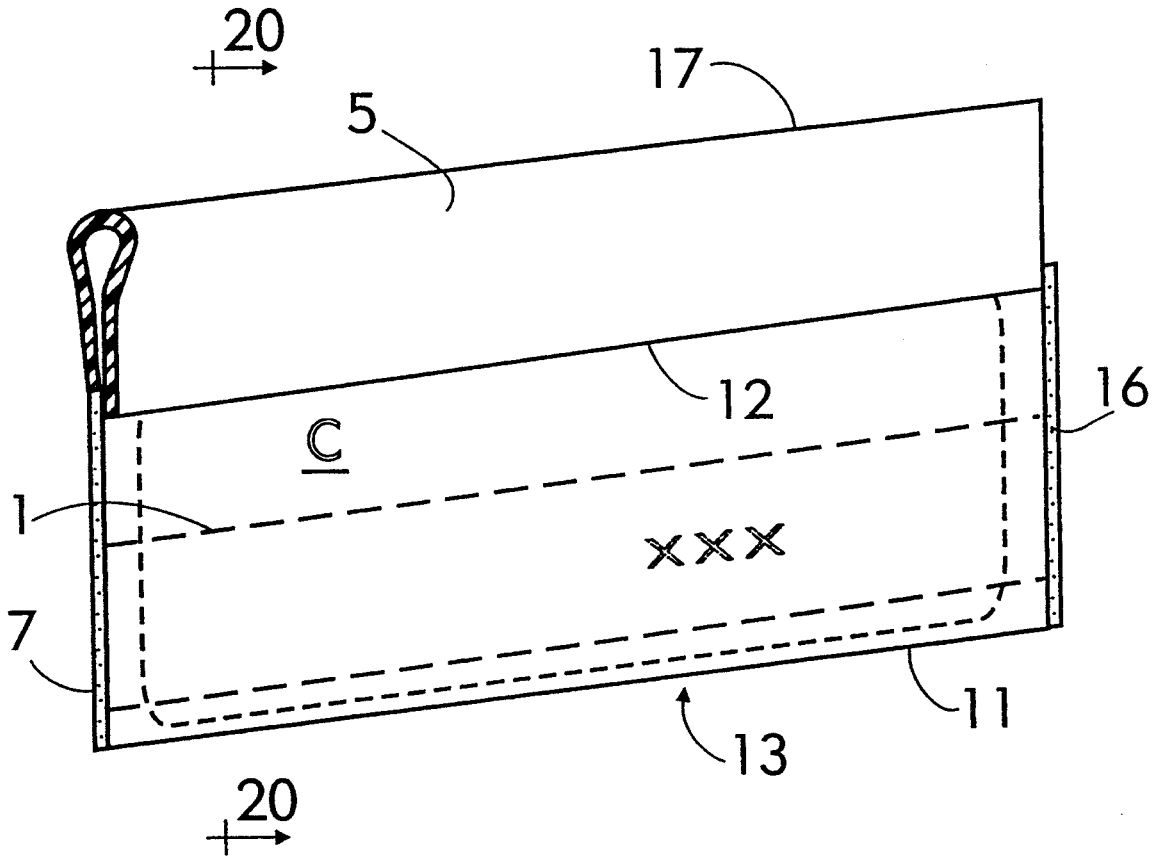
FIG. 7 is a view similar to FIGS. 4–6 showing the envelope fully closed.

Bag 13 may include wicket holes, on a tear-off strip, not shown, extending from edge 12 of back panel 5, to hold it on a dispenser rack or wicket. In one use, bag 13 is blown open as in FIG. 4. Card C is inserted into compartment A and located with its characters XXX disposed behind and facing tamper strip 1. Release liner 9 is then removed and back panel 5 is then folded, on score or serration 6 and/or between notches 6a, which may be half-round or V-shaped. Score or serration 6 becomes fold 17 as shown in FIGS. 6–8, which is the top margin of the closed envelope. Adhesive 8 sticks to front panel 3 and to itself on back panel 5 as shown in FIG. 8. Adhesive 8 is further secured by pressure from the outside along surfaces P1—P1 and P2—P2 as depicted in FIG. 8.

Figure 9:
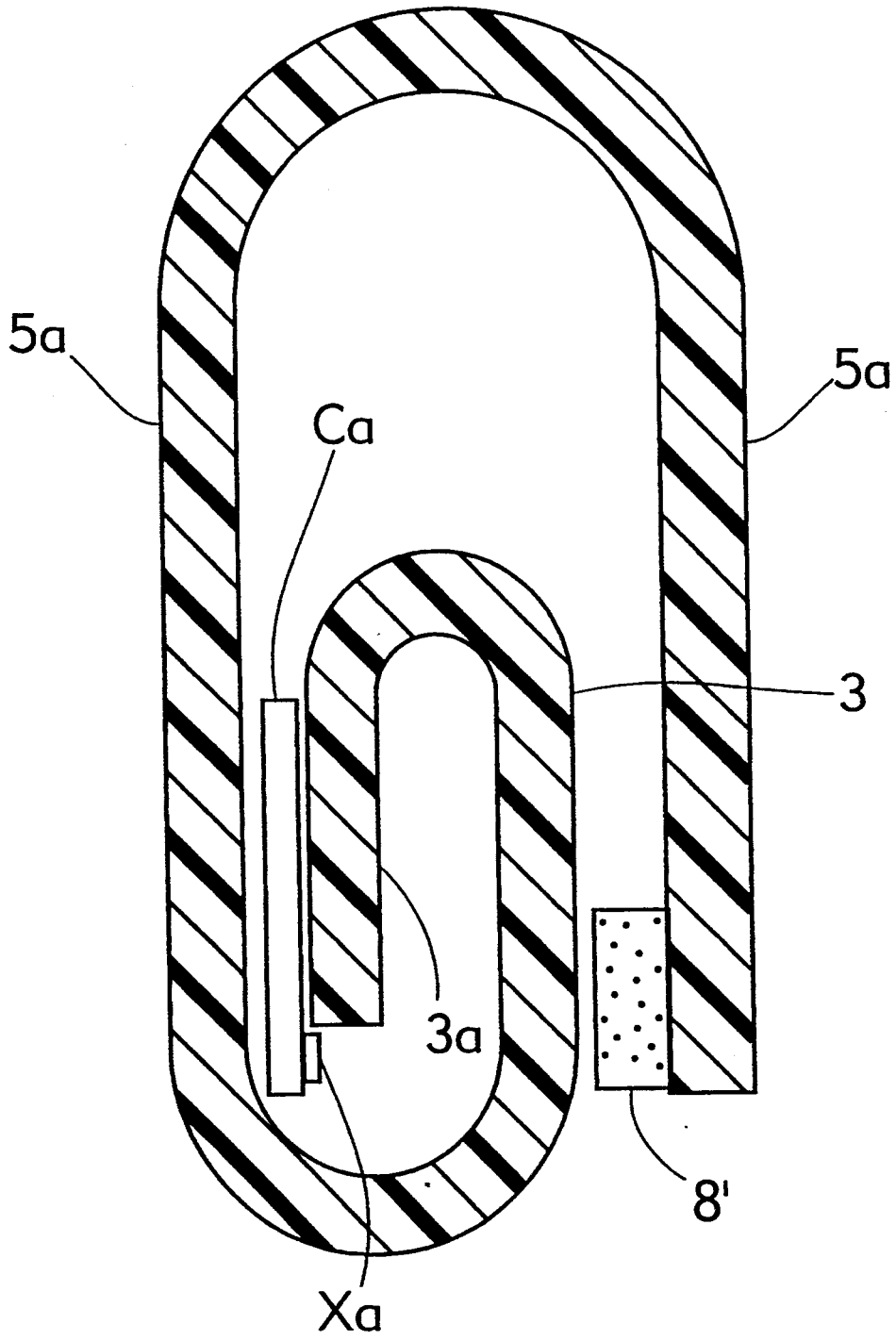
FIG. 9 is a diagrammatic cross-sectional view similar to FIG. 8 showing yet another alternate arrangement of the invention.

It is here noted that a thick band of adhesive 81 may be provided, as shown in FIG. 9 on the upper inner surface of the free end of back panel 5*a*, which is made long enough to extend across front panel 3 in the area of the raised characters Xa on card Ca. In this instance, the adhesive band is the tamper strip which prevents the impression of the characters to be lifted from the outer surface of the envelope. In this embodiment, front inner panel 3*a* may be eliminated.

The tamper-evident characteristics of the envelope of the invention is enhanced by the impregnating of a pattern in the adhesive band which becomes defaced upon reopening the envelope. Conversely, the area of the panel to which the adhesive is to adhere may be printed with a pattern that is disturbed upon attempt to open the envelope or actual opening of the envelope.

The invention is not to be limited to the described constructions and methods but rather to the following claims.

I claim:

1. The combination of an envelope and at least one card having raised identifying characters embossed thereon, said envelope comprising: a front panel and a back panel, each having a bottom, a top and two side edges;

the bottom and side edges of said panels being integrally joined and the top edges being open for placement of the card therein;

a tamper strip located in said envelope; and means for securing said tamper strip to at least one of said panels for disposition between the embossed characters and said at least one panel, said tamper strip absorbing the impression of the characters on the card when pressure is applied onto the card through said envelope to thereby prevent access to said identifying characters.

2. The combination of claim 1, in which said panels are formed of materials selected from the group consisting of heat, sonic, laser, chemically or mechanically sealable material and are sealed along said edges of said panels and said strip.

3. The envelope of claim 1, in which the tamper strip comprises a plastic foam of sufficient rigidity and thickness to prevent transfer of an impression of the card characters therethrough, is disposed between said front and back panels and said securing means secures the side edges of said tamper strip to said side edges of said panels.

4. The envelope of claim 3 in which said panels are comprised of a heat, sonic, laser, chemically or mechanically sealable material and are sealed along said edges of said panels and said strip.

5. The combination of claim 1, wherein said back panel has an extended end and wherein said tamper strip comprises a band of adhesive disposed across a surface of said back panel, means for folding said extended end to cover said front panel and dispose said band of adhesive in the area in which the identifying characters on said card face said front panel, said band of adhesive being of sufficient thickness to prevent transfer of the identifying characters therethrough.

6. The combination according to claim 5, in which the other of said panels to which said adhesive band is to adhere is printed with a pattern which would be defaced upon reopening of the bag, thus comprising tamper-evident means for detecting a prior opening of the adhesive band.

7. The combination of claim 1, in which said panels are formed from a single sheet, folded around said tamper strip, said sheet comprising:

a mid panel disposed behind said tamper strip;

a first fold, around the top of said tamper strip, said first fold joining said mid panel to said front panel of said bag;

said sheet further comprising a second fold, around the bottom of said tamper strip;

said second fold joining said front panel to said back panel;

said means for securing said tamper strip to said panels joining the front panel to the tamper strip to the mid panel to the back panel at the edges of said panels and tamper strip; and said first fold, said mid panel and said back panel defining said card receiving area.

8. The combination of claim 7, in which:

the sheet forming the panels and the tamper strip are made of similar plastic polymers joinable by heat sealing means to each other in a single operation; and the said means for securing said edges together is performed by heat sealing said panels to said tamper strip and to each other in a single operation.

9. The combination of claim 7, in which said back panel further comprises means delineating a folding area for facilitating a third fold in the sheet on the back panel to facilitate closing the envelope.

10. The combination of claim 9, in which said delineating means comprises a linear serration.

11. The combination of claim 9, in which said delineating means is a linear score.

12. The combination of claim 1 including means for sealing the top edges of said front and back panels together to close the envelope.

13. The combination of claim 12, wherein the sealing means comprises a flap integral with one of said panels and provided with means for adhesion for joining the inside surface of said back panel to the outside surface of said front panel and for sealing the card substantially in its location.

14. The combination of claim 12 wherein the means for sealing the top edges comprise an adhesive band fixedly adhered to one of said panels and adapted to adhere to the other panel when folded thereover.

15. The combination of claim 14, in which said adhesive band is impregnated with a pattern which is defaced upon reopening of said envelope and comprising tamper-evident means for detecting a prior opening of the sealing means.

16. The combination according to claim 14, in which the adhesive band is protected from premature adhesion by a removable cover strip.

17. The combination of claim 1 comprising a single sheet folded to form said front and back panels, said back panel having an extended area and having means delineating a folding area in said back panel for facilitating closing said extended area over said front panel.

18. An envelope for enclosing a card having identifying characters, said bag comprising:

a tamper strip comprising a plastic foam of sufficient rigidity and thickness to comprise means for preventing transfer of an impression of the characters therethrough; a sheet folded around said strip, said sheet comprising:

a mid-panel disposed behind said tamper strip, a first fold, around an edge of said tamper strip, said first fold joining said mid-panel to a front outer panel of said sheet, a second fold, around another edge of said tamper strip, said second fold joining the front outer panel to a back outer panel, said sheet having two lateral edges;

the sheet and the tamper strip comprising similar plastic polymers joinable to each other in a single sealing operation; a seal joining the front outer panel to the tamper strip to the inner panel to the back outer panel at the lateral edges of the sheet in a single operation;

said first fold and said back panel defining a card receiving opening;

said panels, and seals comprising means for locating the card with its characters disposed behind and facing the tamper strip;

sealing means for joining an inside of said back panel to an outside of said front panel and sealing the card substantially in its location;

said sealing means comprising an adhesive band for closing the bag;

a removable cover strip protecting the adhesive strip from premature adhesion;

the back panel further comprising means delineating a folding area for a third fold in the sheet on the back panel to facilitate closing the bag or envelope.

* * * * *